US007211544B2

(12) United States Patent
Bossert

(10) Patent No.: US 7,211,544 B2
(45) Date of Patent: May 1, 2007

(54) FLAT MATERIAL ESPECIALLY IN THE FORM OF A SHEET OR A STRIP AND DEVICE FOR WRITING ON SAID MATERIAL

(76) Inventor: Wolfgang Bossert, Muehlstrasse 9, Eberdingen-Nussdorf (DE) 71735

( * ) Notice: Subject to any disclaimer, the term of this patent is extended or adjusted under 35 U.S.C. 154(b) by 0 days.

(21) Appl. No.: 11/307,014

(22) Filed: Jan. 19, 2006

(65) Prior Publication Data

US 2006/0257634 A1 Nov. 16, 2006

Related U.S. Application Data

(63) Continuation of application No. 10/065,927, filed on Dec. 2, 2002, now Pat. No. 7,056,861, which is a continuation of application No. PCT/EP01/05754, filed on May 19, 2001, now abandoned.

(30) Foreign Application Priority Data

| | | |
|---|---|---|
| Jun. 2, 2000 | (DE) | 100 27 574 |
| Oct. 23, 2000 | (DE) | 100 52 523 |
| Nov. 28, 2000 | (DE) | 100 58 972 |

(51) Int. Cl.
*B41M 5/48* (2006.01)

(52) U.S. Cl. ..... 503/207; 428/32.39; 428/32.5; 503/226

(58) Field of Classification Search ..... None
See application file for complete search history.

(56) References Cited

U.S. PATENT DOCUMENTS 5,006,422 A * 4/1991 Sakurai et al. ..... 428/839.3

FOREIGN PATENT DOCUMENTS

EP 0822532 A1 * 4/1998

* cited by examiner

*Primary Examiner*—Bruce H. Hess
(74) *Attorney, Agent, or Firm*—Gudrun E. Huckett

(57) ABSTRACT

A flat sheet material for manufacturing leaf-like sheets for receiving information has at least one coating applied onto a first side of a substrate. Magnetically activatable particles are embedded in the at least one coating. The magnetically activatable particles have a grain size that is smaller than about 3 micrometers. The magnetically activatable particles are iron oxide arranged in a kaolin/SBR layer. A carbonless set can be made from the flat sheet material.

14 Claims, 6 Drawing Sheets

FLAT MATERIAL ESPECIALLY IN THE FORM OF A SHEET OR A STRIP AND DEVICE FOR WRITING ON SAID MATERIAL

This is a continuation application of allowed application Ser. No. 10/065,927, having a filing date of Dec. 2, 2002 now U.S. Pat. No. 7,056,861, which is a continuation of International Application PCT/EP01/05754 with an international filing date of May 19, 2001, not published in English under PCT Article 21(2), and now abandoned.

BACKGROUND OF THE INVENTION

The invention relates to a flat material for manufacturing leaf-like sheets for receiving information, comprising at least one coating applied onto the sheet material, wherein the coating comprises fine cavities. The invention also relates to writing devices for sheet material with a coating in which magnetizable particles are embedded.

Numerous embodiments of flat sheet material for manufacturing leaf-like writing sheets are known wherein such sheets are provided as information carriers whose information contents is designed for optical recognition by means of toner particles applied to the surface. The information is generally in the form of a text comprised of letters or of graphic elements such as drawings or the like. The sheet is generally made of paper comprising cellulose fibers or plastic fibers embedded in a binder or made of a plastic film which is used, for example, for overhead projection. The application of the color is realized by hand with corresponding writing utensils or by printing devices. The information contents combinable on a sheet is generally limited by the readability of, for example, smaller letters.

With the increasing spread of computers, in particular, in office technology, the interaction of optical and electronic information carriers gains increasingly in importance. Modern computer-controlled laser and magnetographic printers enable a resolution of more than 1,000 dpi (dots per inch, dots per approximately 2.54 cm). However, the human eye recognizes only characters which are comprised of a plurality of such dots so that the resolution that is available for a maximum information contents cannot be used. On the other hand, it may be required to convert optically recognizable information into electronic information. For this purpose, text documents are placed onto a so-called scanner and scanned electro-optically. The resulting electronic image of the original requires a large memory space. By means of a subsequent OCR or OMR software (Optical Character Recognition, optical letter recognition; Optical Mark Reading, reading of handwritten or printed marks) the dot information read by the scanner can be converted into character or letter information which causes a significant reduction of the space required in the memory. However, this conversion is time-consuming and requires, according to the present state of the art, generally a manual correction.

A further possibility of conversion of optical recognizable electronic data can be realized by MICR (Magnetic Ink Character Recognition) wherein character recognition is carried out by sensing standardized magnetic fonts in a magnetic toner. According to a further known method, information can be optically recognized in the form of a so-called bar-code comprising a system of stripes of different width and different spacing to one another, for example, fixed on an adhesive label, which can then be scanned by a reading pen or hand-held or long-range scanners. A disadvantage of the aforementioned system is the permanency of once printed information.

The copying of text documents is usually performed by means of photocopying wherein the toner information on a written sheet is optically scanned and transferred onto a drum. In this connection, by means of the so-called magnetographic method the drum is locally magnetically conditioned such that on the corresponding locations of the drum a toner powder adheres and is applied as a copy of the original onto an additional sheet. However, soiling that occurs occasionally can negatively affect the quality of the copy.

SUMMARY OF THE INVENTION

The invention has the object to improve the exchange of electronic and optically recognizable data.

The object is solved by a flat sheet material having a coating in which electrically and/or magnetically activatable particles are embedded. The object is solved in regard to the writing device by a magnetographic writing head for a point-precise magnetic activation of the magnetizable particles or a hand-held pen with a magnetic tip.

In this connection it is suggested to embed in at least one coating of a flat sheet material electrically and/or magnetically activatable particles. The same or an additional coating has fine cavities, for example, in the form of a suitable crystalline structure and, in particular, in the form of microcapsules as they are known in the manufacture of carbonless paper. In particular, by embedding the electrically and/or magnetically activatable particles into the coating with cavities, these particles can be applied together with the coating in a common process onto the sheet material. Such a coating is suitable for large surface area, mass-produced articles so that in an inexpensive way large numbers of leaf-like sheets can be produced on which optical as well as electric or magnetic information or functions can be documented. As a result of the flat distribution, a high information contents by optical as well as, for example, magnetic means or a combination thereof can be recorded on the sheet material.

By means of the combination of optically readable and magnetically stored information, it is possible to produce with the sheet material according to the invention dialogue-capable products on which information can be recorded, changed, and retrieved.

The aforementioned particles are preferably arranged in the aforementioned cavities so that, independent of the contents of the cavities, the coating process can be realized by a method that is already known in mass production of carbonless paper without requiring greater modifications. The corresponding flat sheet material can be produced inexpensively in this way.

Depending on the type of application it can be expedient to configure the cavities and the microcapsules so that they are adapted to one another. For example, it can be expedient to fill the microcapsules with a dye and to embed it together with the electrically and/or magnetically activatable particles into the coating. Embedding of the electrical and/or magnetically activatable particles in a separate layer can simplify the manufacturing process. Also, it can be expedient to arrange the aforementioned particles in their own cavities or microcapsules and to introduce them, for example, as a mixture with microcapsules filled with dye, into the coating. In another advantageous variant, a cavity space contains the so-called dye and an electrically and/or magnetically activatable particle at the same time.

According to a further suggested solution a carbonless set is suggested in which the fine cavities contain a dye which, according to the known prior art, impinges on a dye coreactant when bursting and thus becomes visible. The corresponding coating contains also electrically and/or magnetically activatable particles so that in the carbonless set optically as well as magnetically recognizable information can be recorded separately from one another or so as to interact with one another. In an advantageous configuration the carbonless set is an endless set with a perforated tractor strip and in this way can be used in particular in the data output of computing devices of medium-sized data technology, personal computers, as well as automatic writing and labeling machines. In such devices, with a minimum expenditure optically as well as magnetically recognizable information can be output with great reliability and with correspondingly high output volume. In a further advantageous configuration the carbonless set is formed as a multi-part form set with which advantageously optically as well as magnetically recognizable data can be stored also. Such a multi-part form set has moreover only one parting edge as a result of which, after separation of the multi-part form set, three clean edges remain on the individual sheets which enables their use for representative purposes and particularly in business correspondence.

In an advantageous further development of the invention at least a portion of the cavities in the coating is filled with fragrant agents. For example, in connection with advertisement replies to be filled out, electronic money transfer forms for bills or the like, upon applying a writing device the cavities are crushed and the fragrant agent is released. A suitable fragrance which is perceived positively can increase motivation of the writer. The release can also be realized by activation of embedded electric or magnetizable particles. In a further advantageous embodiment at least a portion of the aforementioned cavities is filled with adhesives. In particular in connection with magnetizable or electrically activatable particles, envelopes produced in this way can be closed in an automated process.

In an advantageous embodiment, the sheet material is divided into zones which are coated with different coatings with differently filled cavities, respectively. In this way, for example, envelopes or the like can be produced which in one zone are provided with cavities filled with adhesive for automatic closing. In another zone having a coating in whose cavities dyes and magnetizable particles are arranged, an optically as well as magnetically readable address field can be provided. In this zone cavities with fragrant agents can be provided also which are released when filling out the address field.

In one suggested solution, cavities containing dyes as well as electrically and/or magnetically activatable particles are embedded in the coating of a flat sheet material. The latter activatable particles interact with the fine cavities in such a way that, for example, magnetic activation causes the cavities to burst so that the dye is released. In cooperation with a dye coreactant, as is known for carbonless sets, information is thus made visible in a magnetic way. For example, by means of a magnetographic printer or the like, letters, signs, bar-codes or the like can be magnetically applied onto the sheet material and can be made visible at the same time. In this way, the information contents is available in magnetically and optically recognizable form on the sheet material at the same time, and this enables an evaluation in an optical as well as electronic way.

In a preferred configuration the aforementioned particles are in the form of magnetizable particles. For a satisfactory data density a grain size of the magnetizable particles of smaller than approximately 2–3 micrometer has been found to be expedient. The magnetizable particles are made of materials conventional for diskettes or hard drives with hard-magnetic properties of high remanence and high coercive force and, in particular, made of chromium dioxide, iron oxide, polycrystalline nickel-cobalt alloys, cobalt-chromium alloy or cobalt-samarium alloy, or barium ferrite.

By way of targeted magnetization of the aforementioned particles it is possible to store information in binary form but also as text similar to an audio tape or a diskette. In particular, when the web or sheet material also comprises a paper layer, it can be written or printed on and in this way can carry optically recognizable information in addition to magnetically recognizable information. In this way, a plurality of advantageous possibilities result, in particular, with respect to dialogue capability. For example, the desired information can be stored magnetically and the web or sheet material can be provided with handwritten additional notes. Also, it is possible to record the same information in written as well as magnetic form on the web or sheet material so that, in this way, the possibility of direct reading by a viewer as well as the possibility of reading by a suitable magnetic sensing device for feeding into a computer are provided.

All mentioned embodiments are advantageously made of heat-resistant materials such that the corresponding sheets can be processed without quality loss in photocopiers, laser printers or magnetographic printers, and other devices with high heat development.

In a further suggested solution a sheet material with electrically and/or magnetically activatable particles is suggested which can be processed to notepad sheets with a self-adhesive strip. Such notepad sheets can be, for example, written on by a hand-held pen having a magnetic tip for taking down telephone messages or the like which are then recorded on such notepad sheets in a form that is optically recognizable as well as magnetically recognizable. Such a notepad sheet can be provisionally secured by means of a self-adhesive strip on a file folder or any other suitable location wherein the information contents, as needed, can be recorded later on by a magnetic scanner and processed further.

In particular, a simple copying action, for example, by means of a magnetographic printer that is only minimally modified, is possible by which, without using toner powder, a direct magnetization of the embedded particles is possible. When simultaneously employing a toner powder, the desired information can be recorded at the same time in a single working step so as to be recognizable magnetically as well as optically. In one embodiment with magnetizable particles and microcapsules filled with dyes, as they are known in connection with carbonless paper, the capsules can burst when exposed to pressure or heat and release the enclosed dye. The initially colorless dye then impinges on a dye coreactant which is provided in the coating with the cavities or at a surface on a carbonless sheet placed underneath. The interaction of the dye with the dye coreactant results in a visible copy. In connection with a suitable device this provides, for example, the possibility of writing on such a sheet only magnetically and to make the stored information visible subsequent to a dialogue process including different retrieval and change or correction processes.

The sheet material according to the invention enables in addition to the above described writing possibilities also additional manipulation possibilities as they are known from conventionally written-on paper sheets. For example, hole punching, stapling, filing and archiving as well as gluing or glue binding are possible as in the case of paper sheets. For this purpose, the sheet material, which is manufactured typically in an elongate form and wound onto rolls, is advantageously cut to the form of a sheet with a standardized basic surface area, in particular, the DIN A4 size (DIN=Deutsche Industrie Norm=German industrial standard), so that it can be processed in conventional printers, copiers and the like and can be archived in standard size file folders. Such a sheet or sheet material advantageously is divided into partial areas of which at least one is formed as a reading/writing area. A further partial area can be provided exclusively for the application of staples, punch holes or glue binding without impairing the stored magnetic information. The reading/writing area is expediently marked by printed markings so that the user can recognize without difficulties where suitable punch holes can be arranged.

In an advantageous variant the sheet material has strip conductors which can be printed on with a conducting dye and expediently are comprised of electrically conducting particles embedded in the aforementioned coating. The particles can be, for example, a metal powder and/or the aforementioned magnetizable particles which fulfill a double function as magnetic data storage means and as an electric transmission element. Expediently, the sheet material is divided into a plurality of reading/writing areas 12 which are connected each to a strip conductor. In this way, structures of the kind of a printed circuit board can be realized in which, for example, the magnetic information of an individual reading/writing area can be retrieved or changed at a remote location by means of a strip conductor.

Microchips, as they are used, for example, in the case of so-called Smart Labels, are also suitable as particles to be embedded into the coating. Such a microchip is expediently connected to the aforementioned strip conductors and enables, for example, an evaluation of the magnetic information stored in the individual reading/writing areas. In an expedient further development on the sheet material an antenna is applied, in particular, by printing, for data exchange with the activatable particles. The antenna can also be formed by the electrically activatable particles. In this way, the field of application of the sheet material is broadened in that the stored information, for example, when passing through a manufacturing process, can be read and/or changed at different locations with different means matched to the situation. For example, the aforementioned sheet material can be guided through a scanner-like device wherein the magnetic information can be sensed. At locations where such a direct access is not possible, the magnetically stored information can be retrieved by the aforementioned antenna, for example, in connection with a microchip, wherein the typical receiving distance is in the range of one meter. When in the context of passing through, a greater retrieval distances are required, the magnetic information, for example, can be made visible by means of the above described microcapsule-dye technology and can be optically sensed. For example, the information can be applied magnetically or optically as a bar-code wherein the optically recognizable bar-code can be read by means of a long-range scanner within a distance range up to approximately 10 m.

Products made of the inventive sheet material such as, for example, carbonless sets, forms, labels, waybills, election ballots, and much more are dialogue-capable and can thus be used in a variety of ways. The sheet material is printable on non-impact printers in several layers wherein the magnetic information can corresponds to the printed information but can also deviate therefrom. For example, in an intelligent waybill, the magnetic information during the course of the transport and an accompanying dialogue process can be matched to the respective actual status and, for example, can be made visible upon delivery.

In a further suggested solution, a mailing pouch and, in particular, an envelope are formed of a flat sheet material with electrically and/or magnetically activatable particles. For example, in connection with a magnetic writing device, such as a magnetographic printer or a hand-held pen with a magnetic tip, an address can be recorded optically recognizable for the mail person on such an envelope while the magnetically applied information applied at the same time can contribute to an improved automated letter delivery.

In a further suggested solution, a brochure is formed of the sheet material with the electrically and/or magnetically activatable particles. As a result of the simultaneous optic and magnetic writing possibility in a simplified way a so-called personalization of the brochure is possible in that, for example, personal or address data can be retrieved from a database and can be applied onto the brochure in a computer-controlled way so as to be magnetically and/or optically recognizable. For example, an advertisement brochure can be addressed personally to the individual client on the cover sheet while the magnetically recognizable information available at the same time simplifies an automated management and delivery to the client.

In a further suggested solution, a folder, in particular, for text documents, is formed of the sheet material with a coating containing electrically and/or magnetically activatable particles. Banks, insurance companies or the like can compile in such folders in a simplified way client-specific information and/or offers wherein the folder, on the one hand, discloses as optically recognizable printed text, for example, the addressee while the magnetically stored information stored at the same time in regard to this addressee simplifies an automated managing of this folder inclusive of the offers contained therein.

In a further suggested solution, the sheet material with electrically and/or magnetically activatable particles is processed to zigzag-folded stockform paper. Such a stockform paper can be used particularly advantageously in data processing devices when a large data volume must be recorded on paper without supervision. The zigzag-folded paper can be taken in and processed with suitable printers provided with a tractor device with high reliability wherein the desired information can be recorded on the stockform paper in an optically as well as magnetically readable form. For correspondingly large amounts of data, a further electronic processing is expedient which is assisted by the magnetic readability. At the same time, the optical readability provides for control by random sampling.

For application of the magnetic information on a sheet material with embedded magnetizable particles a writing device having a magnetographic printing head is suitable. By means of such a magnetographic printing head, as they are known from magnetographic printers, magnetizable particles can be conditioned precisely to a point along its longitudinal axis. By means of a relative movement of the sheet material relative to the magnetographic writing head transverse to its longitudinal axis, each individual point on the sheet material can be magnetized in the desired way in a fashion comparable to a laser printer or a photocopier. In this connection, very high writing speeds can be achieved and also a very high data density.

In an expedient configuration of the writing device two opposed magnetographic writing heads are aligned relative to one another and form an intermediate gap through which the sheet material can be guided. With the opposed alignment a high magnetic field strength and thus a reliable magnetic conditioning of the magnetizable particles in the sheet material can be achieved. Expediently, a magnetic reading device is arranged downstream with which the magnetic information on the sheet material can be read. In this way, a combination device for writing and/or reading is provided. In particular, with a suitable embodiment the magnetically written information can be immediately checked by the downstream magnetic reading device with regard to errors of the recorded magnetic data. This contributes to data safety in particular when the recordation of the information is carried out initially only magnetically without providing optical visibility and thus a control possibility.

The above described writing device is advantageously embodied as an add-on unit for a conventional printer. In this way, already present printing machines or also inexpensive workplace printers produced in mass production can be expanded with minimal additional expenditure such that the known data processing with optically readable information is expanded by the magnetically stored information. In a corresponding combination of the writing device and configuration of the sheet material large quantities of sheets can be inexpensively written on without toner, ink and the like in an optically and magnetically readable way.

Moreover, it is suggested to configure a writing device in the form of a hand-held pen which has a magnetic tip. For example, in connection with, self-dying paper with such a hand-held writing device ink in the same way as with a pencil or ballpoint pen information can be written onto the paper in an optically readable way wherein by means of the magnetic tip the same information is also applied magnetically for automated data recognition. With such a writing device, for example, election ballots, bank orders, or the like made of a corresponding sheet material can be written on by hand, and can be evaluated subsequently in large numbers reliably and at high speeds by means of a magnetic reading device. The pen-shaped writing device, depending on the application, can have a pure magnetic tip or a combination of magnetic tip and, for example, a ballpoint pen refill or the like.

A suitable sheet material can be produced, for example, in that iron oxide is arranged within a kaolin/SBR latex layer and applied by doctor onto a paper substrate of, for example, 49 $g/m^2$. In this connection, the magnetizable particles have typically a surface density of approximately 0.1 to 0.4 $g/m^2$. A conventional CB coating (coated back) imparts to the sheet material additionally the properties of a known carbonless paper. In a further variant for manufacturing the sheet material magnetizable particles, for example, made of Mn—Zn-ferrite with a grain size of <3 micrometer are embedded by a conventional method for microcapsule formation in such microcapsules. The manufacture of microcapsules can be realized, for example, in an oil-based emulsion with gelatin and gum arabic. The emulsion can, for example, be applied by doctor or by printing onto the paper substrate. The printing method can be any known printing method and, in particular, rotogravure printing. The arrangement of magnetizable particles in the microcapsules prevents, in addition to the aforementioned advantages, also an undesirable dying of the sheet material. As a protection against bursting of the microcapsules upon application onto the paper substrate a suitable protective additive, for example, in the form of wheat starch can be applied. The surface density of the magnetizable particles is expediently in the range of 0.1 and 1.2 $g/m^2$. In the case of separate coatings for the microcapsules and the magnetizable particles, any suitable coating sequence can be selected. It may also be expedient to arrange the layers on two different sides of the sheet material. For further processing of the sheet material and also for application of magnetizable information the further processing of the sheet material in the form of rolls can be expedient.

DESCRIPTION OF PREFERRED EMBODIMENTS

Figure 1:
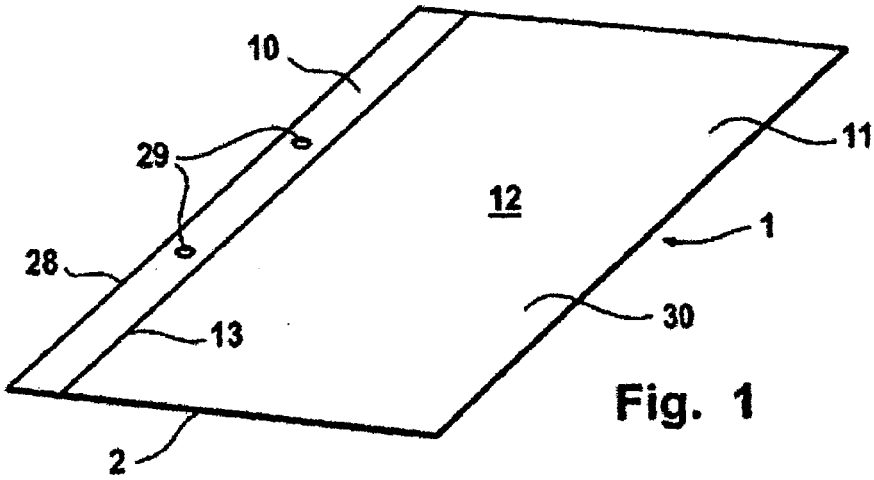
FIG. 1 shows a perspective overview illustration of a printed and magnetically writable sheet.

FIG. 1 shows a sheet 1 which has been cut from sheet material 2 and comprises a carrier layer 30 which is divided into two partial areas 10, 11. The partial area 10 extends along the longitudinal edge 28 and has punch holes 29. The other partial area 11 forms a reading/writing area 12 and is marked by printed markings 13. The sheet 1 can have any suitable size and in the illustrated embodiment has DIN A4 size.

Figure 2:
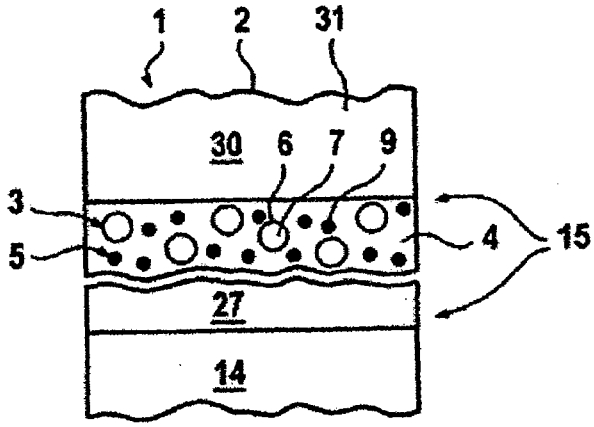
FIG. 2 shows schematic illustration of a cross-sectional enlargement of the sheet of FIG. 1, compiled with an additional sheet to form a carbonless set.

FIG. 2 shows an enlarged detail view of a cross-section of a carbonless set 15 with a sheet 1 according to FIG. 1, wherein the carrier layer 30 of the sheet material 2 is comprised of paper 31; any desired paper quality as well as paperboard or cardboard can be used. Onto the carrier layer 30 a coating 4 is applied in which cavities 3 and electrically and/or magnetically activatable particles 5 are embedded.

The cavities 3 can be formed by a suitable crystalline configuration of the coating 4; in the illustrated embodiment, they are microcapsules 6 filled with a dye 7. The activatable particles 5 can be carbon particles or other electrically conducting particles; in the illustrated embodiment, they are metallic magnetizable particles 9. The sheet 1 is compiled with an additional sheet of sheet material 14 to form a carbonless set 15 wherein the sheet material 14 is coated with a dye coreactant 27 which in interaction with the dye 7 in the microcapsules 6 causes a coloration. The sheet material 14 can additionally be coated with a coating 4 corresponding to that of the sheet material 2. The magnetizable particles are made of materials conventional for diskettes or hard drives with hard-magnetic properties of high remanence and high coercive force and, in particular, made of chromium dioxide and, for example, also of iron oxide, polycrystalline nickel-cobalt alloys, cobalt-chromium alloy or cobalt-samarium alloy, or barium ferrite. The grain size is approximately 2–3 micrometers. The employed materials are heat-resistant.

Figure 3:
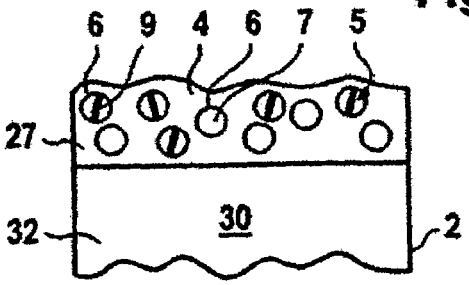
FIG. 3 is a cross-sectional illustration of a variant of the sheet according to FIG. 1 with magnetizable particles in microcapsules.

FIG. 3 shows a variant of the sheet material 2 in which different types of microcapsules 6 are embedded as a mixture in the coating 4. A portion of the microcapsules 6 is filled with a dye 7 and a further portion of the microcapsules 6 with magnetizable particles 9. The further portion of the microcapsules 6 is filled with the dye 7 as well as with corresponding activatable particles 5. An additional portion of the microcapsules 6 contains, in addition to the magnetizable particles 9, a fragrant agent 55 or an adhesive 56, respectively. Moreover, the dye coreactant 27 is introduced into the coating 4. The dye 7 or the fragrance 55 or the adhesive 56 can be released from the cavities 3 by activation of the particles 5. The dye 7 then impinges on the embedded dye coreactant 27 and thus becomes visible. The activation of the particles 5 can be realized magnetically or electrically and, in particular, by employing a heat effect. The sheet material 2 can be used as a single layer for receiving data of the magnetic kind and according to the above described microcapsules principle. The carrier layer 30 in the embodiment according to FIG. 2 can be made of paper 31 and in the illustrated embodiment is a film 32 of PET.

Figure 3B:
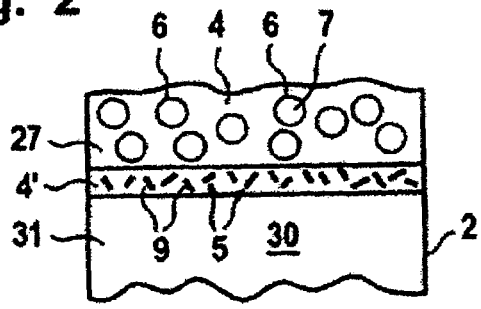
FIG. 3*b* is a variant of the arrangement of FIG. 3 with magnetizable particles in a separate coating.

FIG. 3*b* shows a variant of the arrangement according to FIG. 3 in which the carrier layer 30 is provided with two additional different coatings 4, 4'. The coating 4 contains microcapsules 6 while the magnetizable particles 9 are arranged in the additional coating 4'. The carrier layer 30 is comprised in the illustrated embodiment of paper 31. In regard to the other features and reference numerals, the arrangement of FIG. 3*b* is identical to the arrangement of FIG. 3.

Figure 4:
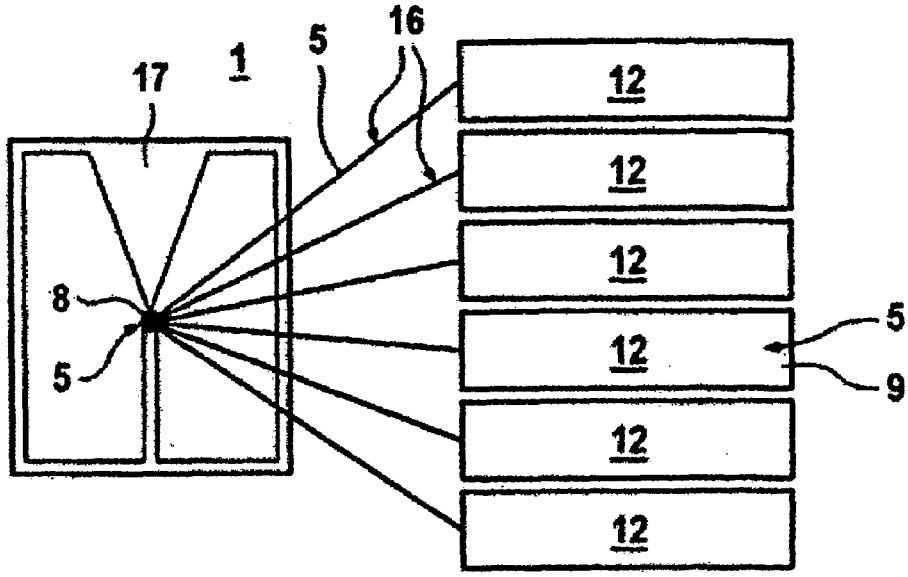
FIG. 4 shows a schematic illustration of an arrangement of reading/writing areas in connection with a microchip and a transmission antenna.

FIG. 4 shows in a schematic illustration a section of a sheet 1 on which a plurality of reading/writing areas 12 are provided. In the area of these reading/writing areas 12 the activatable particles 5 in the form of magnetizable particles 9 are provided. The reading/writing areas 12 are connected by a strip conductor 16 with a microchip 8, respectively. The strip conductors 16 can be glued on or can be printed on of a conducting dye; in the illustrated embodiment, they are formed of electrically conducting activatable particles 5. The microchip 8 forms also an activatable particle 5 embedded into the coating 4. The microchip 8 is arranged at the focal point of a printed antenna 17 via which the information contents of the reading/writing areas 12 can be transmitted onto a remote reading device (not illustrated). Text or, for example, bar-codes can be printed onto the reading/writing areas 12, wherein, for example, the bar-code can also be stored magnetically with magnetizable particles 9 and can thus be retrieved by the antenna 17. It is also possible to employ in addition to the known one-dimensional bar-codes two-dimensional bar-codes with corresponding increased memory density.

Figure 5:
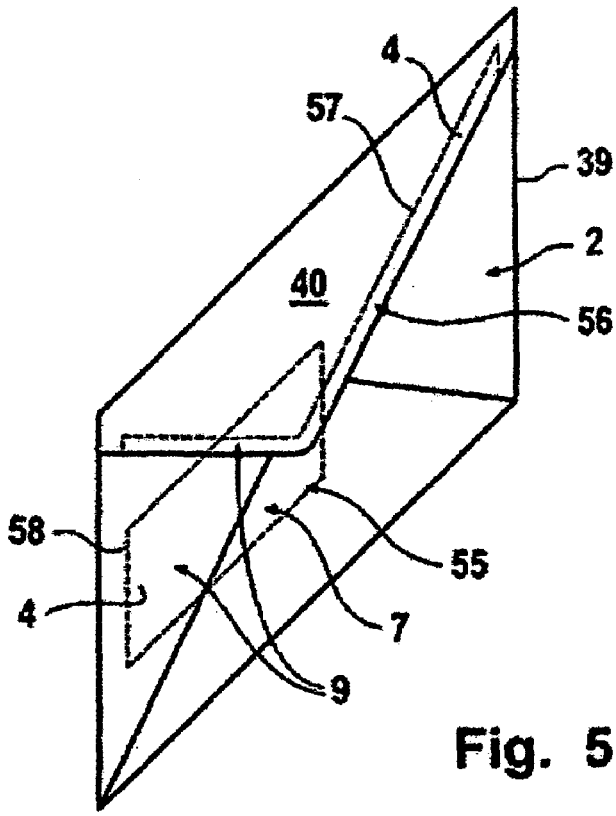
FIG. 5 a schematic illustration of an envelope with magnetizable particles.

FIG. 5 shows a mailing pouch 39 in the form of an envelope 40 comprised of a sheet material 2 according to FIG. 1. The mailing pouch 39 can be embodied in any suitable letter size or can also be sized as a packet pouch, package envelope of coated cardboard or the like. The sheet material 2 of the envelope 40 has two zones 57, 58 which are provided with different coatings 4. The zone 57 serves for automated closing of the envelope 40 wherein its coating 4 contains adhesives 56 and magnetizable particles 9 similar to FIG. 1. On the opposite side, the envelope 40 has an address field which is formed by the additional zone 58. Its coating 4 contains magnetizable particles 9 as well as dyes 7 and a fragrance 55.

Figure 6:
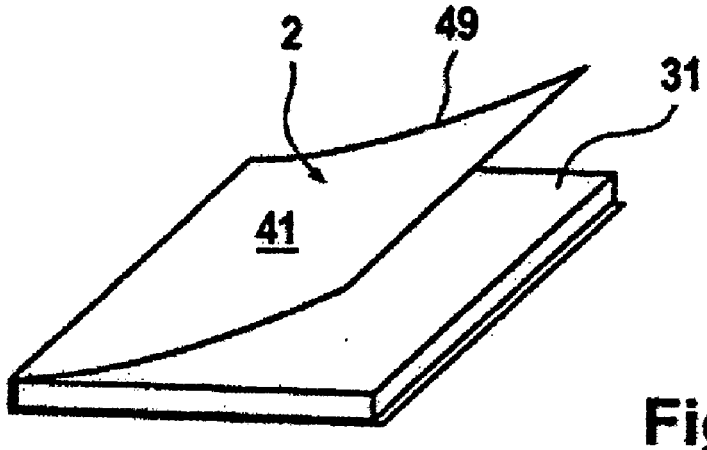
FIG. 6 a schematic illustration of a personalizable brochure.
Figure 7:
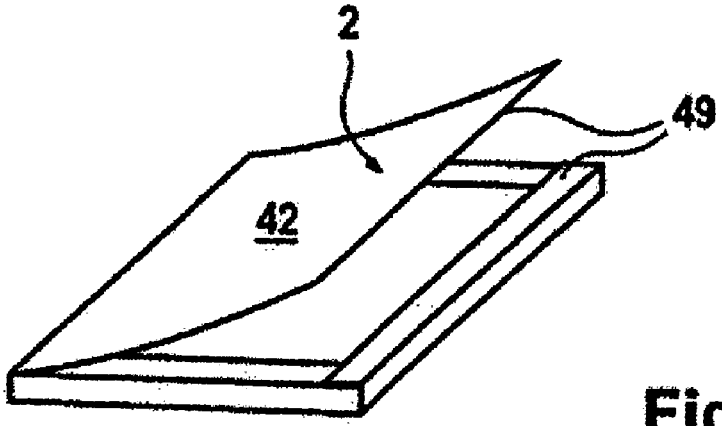
FIG. 7 a schematic illustration of a personalized folder.
Figure 8:
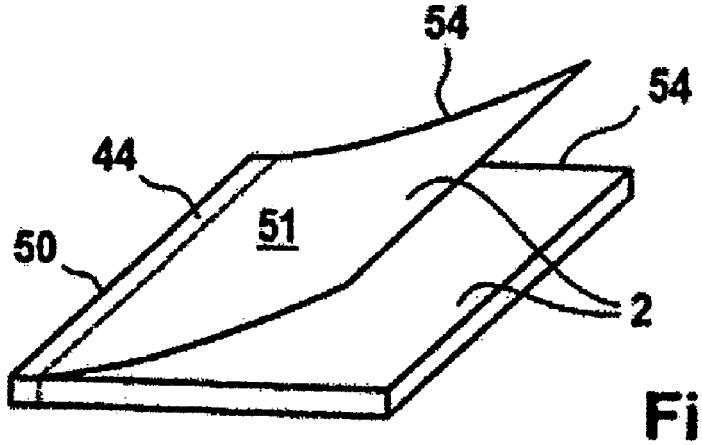
FIG. 8 a schematic illustration of a notepad with self-adhesive strips and magnetically activatable particles.

FIG. 6 shows a brochure 41 in which a stack of paper 31 is bound in a cardboard 49. The cardboard 49 is formed as a sheet material 2 according to FIG. 1 with activatable particles 5. Moreover, the paper 31 can also be embodied in the form of the sheet material 2 according to the invention. According to FIG. 7, a personalizable folder 42 for proposals, insurance documents or the like is formed of the inventive sheet material 2 in the form of a coated cardboard 49. FIG. 8 shows a notepad 51 made of the inventive sheet material 2 whose individual notepad sheets 54 have a self-adhesive strip 44 on a common edge 50, respectively, with which the individual notepad sheets 54 are held together and with which an individual notepad sheet can be attached as needed to any suitable surface.

Figure 9:
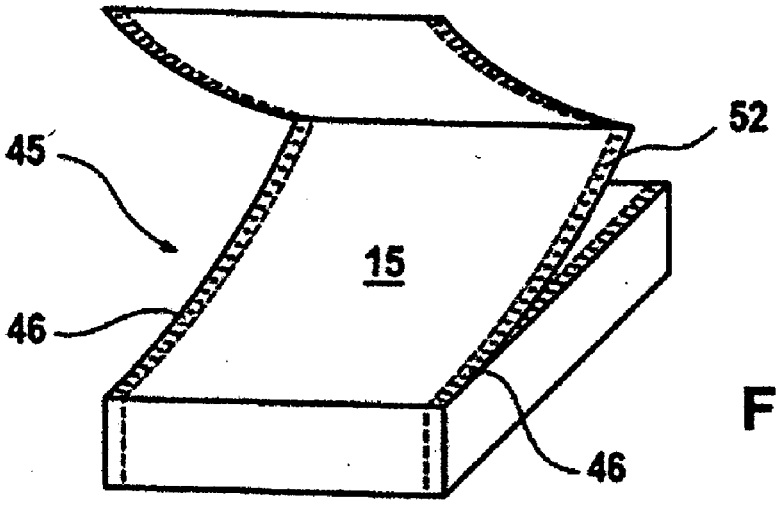
FIG. 9 a schematic illustration of an endless set of sheet material according to FIG. 2.

FIG. 9 shows an endless set 45 which is formed of a carbonless set 15 according to FIG. 6. The individual layers of the sheet material 2, 14 (FIG. 2) of the carbonless set 15 are connected to one another in the area of the perforated tractor edge 46 for a printer tractor, for example, by crimping, adhesive binding or by a multiflex binding. After completion of printing, the perforated tractor edge 46 can be separated along a perforation 52.

Figure 10:
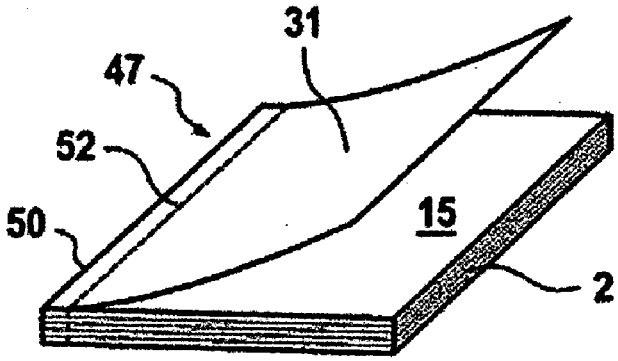
FIG. 10 a schematic illustration of a multi-part form set made of the sheet material according to FIG. 2.

FIG. 10 shows a multi-part form set 47 which is comprised of a multi-layer carbonless set 15 made of an inventive sheet material 2 according to FIG. 2 as well as an upper cover layer of paper 31. The individual layers are glued together along an edge 50; the glued edge 50 can be separated along a perforation 52 for separating the individual layers.

Figure 11:
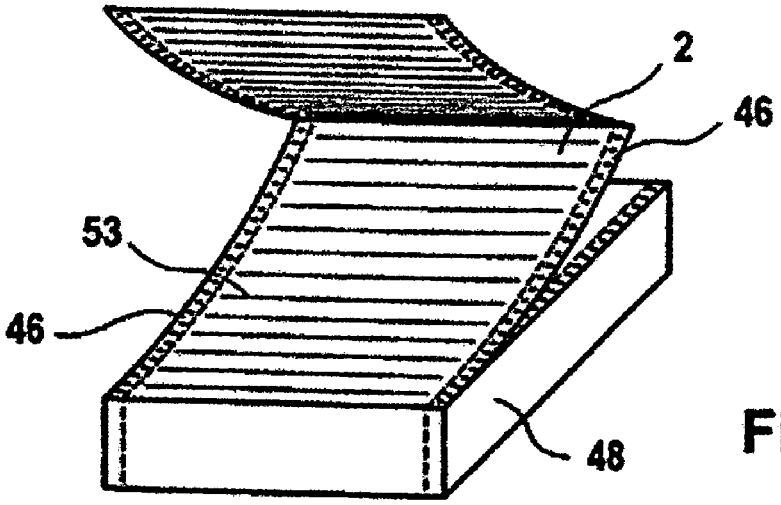
FIG. 11 a schematic illustration of a zigzag-folded stock-form paper with magnetizable particles.

FIG. 11 shows a zigzag-folded stack of stockform paper 48 made of sheet material 2 according to FIG. 1. The sheet material 2 has lines 53 as well as a lateral perforated tractor edge 46 for a printer tractor.

Figure 12:
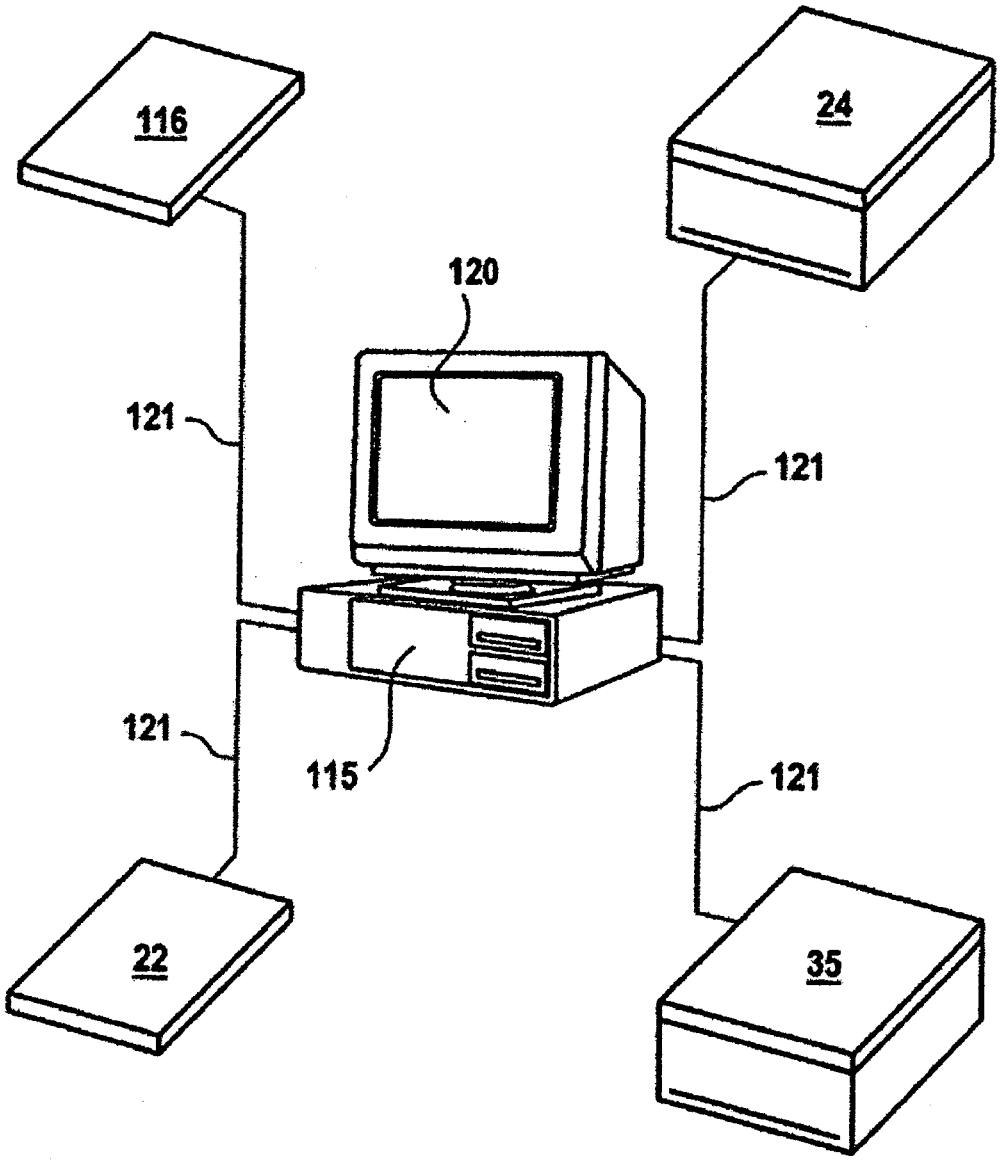
FIG. 12 a schematic overview illustration of a computer system for information processing with the sheets according to the invention.

FIG. 12 shows in a schematic illustration combined the essential components of an office computer device for combined optical and magnetic processing of the inventive sheets. For this purpose, as a central element a computer 115 is provided in which texts or graphic images are produced and are displayed on the corresponding monitor 120 during the processing phase. Optionally, a text already present on a paper sheet can be scanned by an electro-optical scanner 116 and can be sent by line 121 into the computer 115 for further processing. Finished texts can be printed by means of a printer 24 onto a sheet for optical recognition by a user.

In a manner which is comparable to the described optical processing with the illustrated system, magnetic information can be produced on the inventive sheet 1 (FIG. 1–FIG. 4) by means of a magnetic reading device 22 and a magnetic writing device 35. The magnetic reading unit 22 and the magnetic writing device 35 are also connected by line 121 with the computer 115, respectively. The magnetic information on a sheet 1 can be read by the magnetic reading device 22 and can be processed in the computer 115 and can be displayed on the monitor 120. After processing, the resulting magnetic information can be written magnetically onto the sheet 1 by means of the magnetic writing device 35 which is, in particular, a modified magnetographic printer. With the illustrated arrangement a mutual conversion of magnetic to optically recognizable information and vice versa is possible. Magnetic information which is read, for example, by the magnetic reading unit 22 can be printed in an optically recognizable form by the printer 24 onto a sheet 1. In addition, the printed sheet 1 can be subsequently provided with the corresponding magnetic information by the magnetic writing device 35.

The illustrated individual devices combined to a system can also be combined, as needed, to combination devices. For example, a reading device for the inventive sheets 1 is expedient in which the optical scanner 116 and the magnetic reading device 22 are combined wherein both information types can be sequentially or simultaneously read, depending on the configuration of the device. Also, the printer 24 can be combined with the magnetic writing device 35 in a combination device. When employing the magnetographic method, for example, the magnetic information and, when using a toner, also the optically recognizable information can be applied simultaneously onto a sheet 1.

A writing device may be advantageous with which by means of a combined magnetographic and thermodynamic process a sheet 1 according to FIG. 3 is sequentially written on magnetically and subsequently by activation of the microcapsules 6 (FIGS. 2 and 3) which are filled with a dye. Moreover, combination devices of the magnetic reading device 22 and the magnetic writing device 35, optionally in connection with an electro-optical scanner 116 and/or a printer 24 can be expedient. In this way, a copying device similar to a known photocopier can be provided. In all aforementioned device combinations optionally a control unit can be integrated so that a connection to a computer 115 is no longer required.

Figure 13:
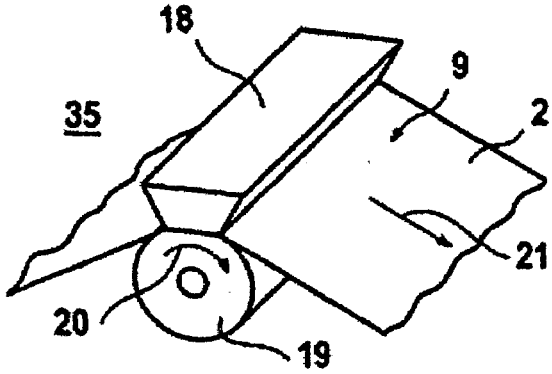
FIG. 13 a basic illustration of a magnetic writing device.

FIG. 13 shows in a basic illustration a section of a magnetic writing device 35 wherein a sheet material 2 with embedded magnetizable particles 9 is guided along a magnetographic writing head 18. The magnetographic writing head 18 corresponds in its length approximately to the width of the sheet material 2 so that transversely to the transport direction 21 by means of the magnetographic writing head 18 each individual point on the sheet material 2 can be precisely magnetized. The sheet material 2 is pressed by means of a drum 19 against the magnetographic writing head 18 and transported by rotation in the direction of arrow 20.

Figure 14:
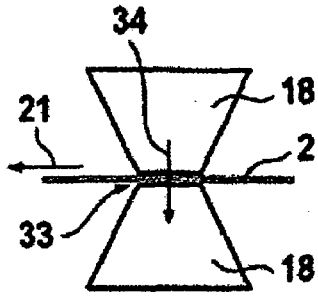
FIG. 14 a variant of the writing device according to FIG. 13.

FIG. 14 shows a basic illustration of a variant of the writing device 35 according to FIG. 13 according to which two opposed magnetographic writing heads 18 are aligned with one another such that between them a narrow gap 33 remains. The sheet material 2 can be guided through the gap 33 in the transport direction 21. The two opposed and aligned magnetographic writing heads 18 generate in the gap 33 a strong magnetic field in the direction of arrow 34 for conditioning the magnetizable particles 9 (FIG. 2 and the following) in the sheet material 2.

Figure 15:
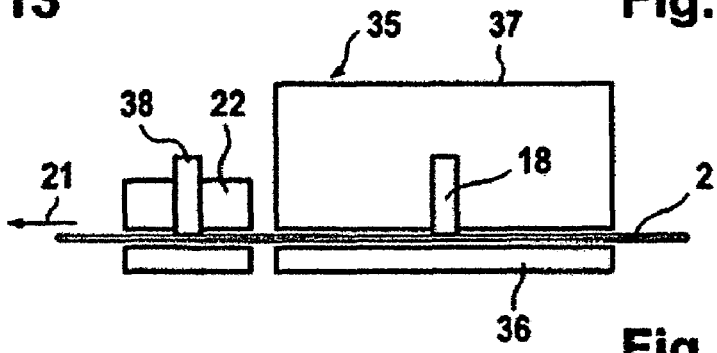
FIG. 15 a basic illustration of a combination of writing and reading device.

FIG. 15 shows in a principal illustration the important components of the magnetic writing device 35 wherein the magnetographic writing head 18 is arranged in a writing unit 37 such that the sheet material 2 can be guided past it by means of a plate 36 in the transport direction 21. In a magnetic reading device 22 arranged downstream a reading head 38 is provided with which the magnetic reading unit 22 can read for itself or can be used as a control unit for the information written in the writing unit 37.

Figure 16:
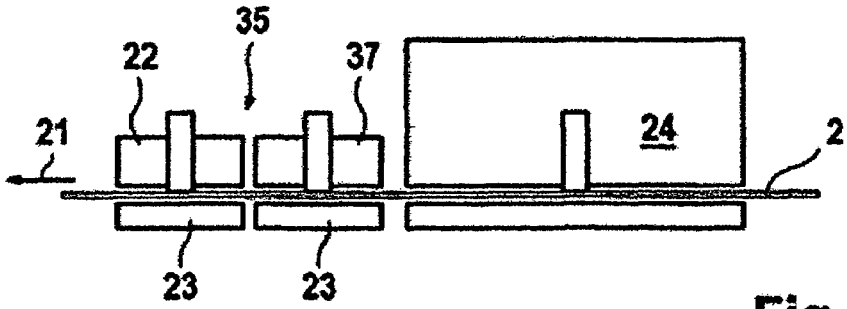
FIG. 16 the arrangement according to FIG. 15 in connection with a conventional printer.

FIG. 16 shows the writing device 35 according to FIG. 15 as an expansion of a conventional printer 24 which can be a laser printer or an inkjet printer. The printer 24 can also be a matrix printer wherein, in connection with, for example, the sheet material according to FIG. 2 and FIG. 3 and the above described dye microcapsule technology, an ink ribbon, toner or the like is no longer needed. The magnetic writing device 35 in the illustrated embodiment is arranged relative to the transport direction 21 of the sheet material 2 downstream of the printer 24 as a result of which, in addition to the optically recognizable lettering of the sheet material 2 in the printer 24, magnetic information via the magnetic writing device 35 can be provided. It may be expedient to provide the magnetic writing device relative to the transport direction 21 upstream of the printer 24 so that, for example, a magnetic information on the sheet material 2 can be read first and, as needed, can be made visible by the printer 24.

Figure 17:
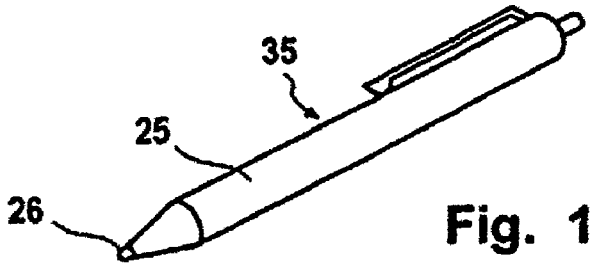
FIG. 17 a basic illustration of a writing pen with a magnetic tip.

FIG. 17 shows a further embodiment of a magnetic writing device 35 which is in the form of a hand-held pen 25. The pen 25 has a magnetic tip 26 for magnetic conditioning of the magnetizable particles 9 in the sheet material 2 (FIG. 2 and the following). The pen 25 can be embodied, for example, as a combination device as a ballpoint pen or pencil in connection with a magnetic tip 26.

What is claimed is:

1. A flat sheet material for manufacturing leaf-like sheets for receiving information, said sheet material comprising:

at least one coating applied onto a first side of a substrate;

magnetically activatable particles embedded in said at least one coating;

wherein said magnetically activatable particles have a grain size that is smaller than about 3 micrometers; and wherein said magnetically activatable particles comprise iron oxide arranged in a kaolin/SBR layer.

2. The flat sheet material according to claim 1, comprising a layer of microcapsules arranged on a second side of said substrate opposite said at least one coating.

3. The flat sheet material according to claim 1, wherein said grain size is approximately 2 micrometers to 3 micrometers.

4. The flat sheet material according to claim 1, wherein said magnetically activatable particles have a surface density of 0.1 $g/m^2$ to 1.2 $g/m^2$.

5. The flat sheet material according to claim 1, further comprising a strip conductor.

6. The flat sheet material according to claim 1, further comprising a microchip.

7. The flat sheet material according to claim 1, wherein said substrate is paper so that information is writable or printable on said paper and said information written or printed on said paper is provided in addition to magnetically recognizable information.

8. A carbonless set for storing optically and magnetically recognizable data, said carbonless set comprising:

a flat leaf-like sheet comprising at least one coating applied onto a first side of a substrate;

magnetically activatable particles embedded in said at least one coating;

wherein said magnetically activatable particles have a grain size that is smaller than about 3 micrometers;

wherein said magnetically activatable particles comprise iron oxide arranged within a kaolin/SBR layer; and wherein information is writable, retrievable and changeable on said carbonless set when arranged in a magnetic field by magnetization of said magnetically activatable particles.

9. The carbonless set according to claim 8, comprising a layer of microcapsules arranged on a second side of said substrate opposite said at least one coating.

10. The carbonless set according to claim 8, wherein said grain size is approximately 2 micrometers to 3 micrometers.

11. The carbonless set according to claim 8, wherein said magnetically activatable particles have a surface density of 0.1 $g/m^2$ to 1.2 $g/m^2$.

12. The carbonless set according to claim 8, further comprising a strip conductor.

13. The carbonless set according to claim 8, further comprising a microchip.

14. The carbonless set according to claim 8, wherein said substrate is paper so that information is writable or printable on said paper and said information written or printed on said paper is provided in addition to magnetically recognizable information.

* * * * *